United States Patent [19]

Breslow

[11] 4,037,842

[45] July 26, 1977

[54] TARGET DEVICE FOR PINBALL GAMES

[75] Inventor: Jeffrey D. Breslow, Highland Park, Ill.

[73] Assignee: Marvin Glass & Associates, Chicago, Ill.

[21] Appl. No.: 575,975

[22] Filed: May 8, 1975

[51] Int. Cl.[2] ..... A63B 71/00

[52] U.S. Cl. ..... 273/127 R; 200/61.11; 273/121 A

[58] Field of Search ..... 273/118 A, 118 D, 119 A, 273/119 R, 120 A, 120 R, 121 A, 121 R, 122 A, 122 R, 123 A, 123 R, 124 A, 124 R, 125 A, 125 R, 126 A, 127 D, 127 R, 127 C, 102.2 R, DIG. 26, 41, 127 A; 200/61.1, 61.11

[56] References Cited

U.S. PATENT DOCUMENTS

| | | | |
|---|---|---|---|
| 1,949,488 | 3/1934 | Rockola | 273/121 A |
| 2,092,157 | 9/1937 | Hansen | 273/119 R |
| 2,206,318 | 7/1940 | Comoletti | 273/127 D |
| 3,063,719 | 11/1962 | Rosenberger | 273/118 A |
| 3,877,701 | 4/1975 | Foster | 273/119 A |
| 3,897,952 | 8/1975 | Breslow | 273/127 D |

*Primary Examiner*—Richard C. Pinkham
*Assistant Examiner*—T. Brown
*Attorney, Agent, or Firm*—Mason, Kolehmainen, Rathburn & Wyss

[57] ABSTRACT

A target device for a pinball game, including a plurality of independently pivotal score or target indicators mounted on the playing surface for pivotal movement about a generally horizontal axis. The indicators each are movable between a first generally horizontal position on one side of the axis to a second generally horizontal position on the other side of the axis. A U-shaped yoke is mounted for generally vertical reciprocal movement by a solenoid armature mounted below each of the indicators so that one arm of the U-shaped yoke will contact the indicator in its first position and the other arm of the U-shaped yoke will contact the indicator in its second position. In one form of the invention, energization of a solenoid will cause its U-shaped yoke to move upwardly to contact the respective indicator to move it from its first position to its second position or from its second position to its first position, depending on the position of the indicator. In another form of the invention, a lockout switch is mounted adjacent each indicator and operated by the indicator when in its second position to prevent operation of that solenoid until all of the indicators have been moved to the same position on the same side of the axis. A lockout override circuit is provided to prevent operation of the lockout switches and can be operated either manually or automatically when all of said indicators have moved to the lockout position.

16 Claims, 7 Drawing Figures

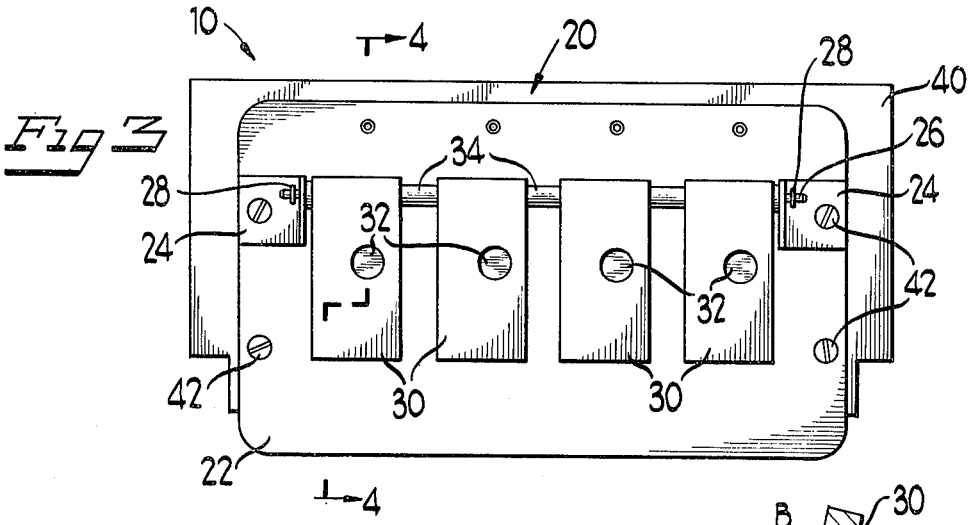
Fig 3
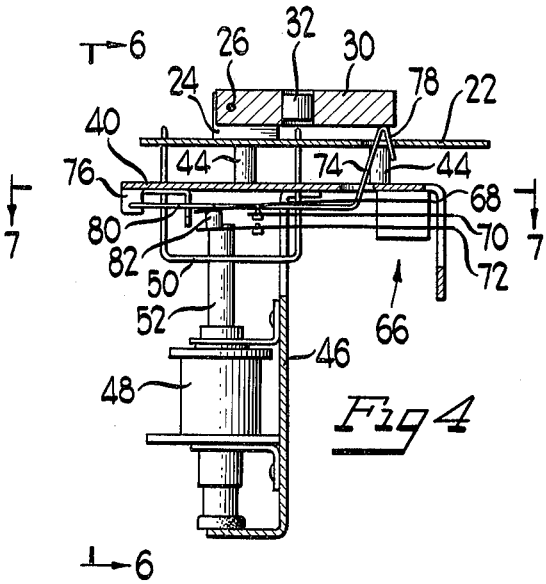
Fig 4
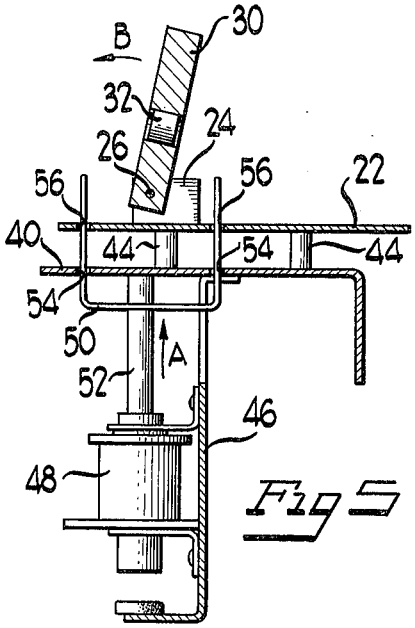
Fig 5
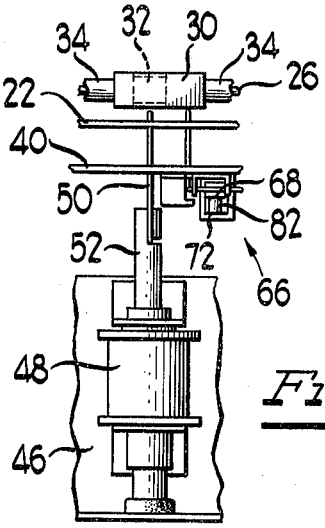
Fig 6
Fig 7
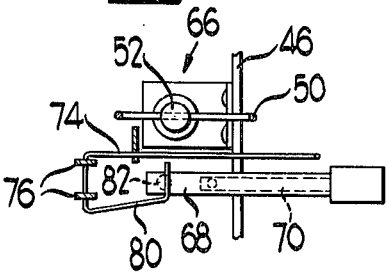

TARGET DEVICE FOR PINBALL GAMES

BACKGROUND OF THE INVENTION

1. Field of the Invention

This invention relates to pinball games and particularly to an improved target device for use with pinball games.

2. Description of the Prior Art

Pinball games have been provided with a great number of different types of target objects. Most of the targets include some type of switch which is actuated when the pinball contacts the target. This switch is connected to a scoring mechanism so that, upon contact by the pinball, a predetermined score or scoring series is awarded to the player of the game. Improved electronic circuitry has greatly enhanced the popularity and versatility of pinball games and their scoring systems while not necessitating a change in the type of target provided for the game.

SUMMARY OF THE INVENTION

An object of the present invention is to provide a new and improved pinball game target device which permits the players of the game to view the actual movement or change in position of the various target elements.

In accordance with the concepts of the present invention, a pinball game target device is provided which includes a plurality of pivotal indicators mounted on a generally horizontal common axis above the playing surface. The indicators are pivotal between a first (or "beginning") position and a second (or "lockout") position which are on opposite sides of the common axis. A generally U-shaped yoke is mounted for reciprocal movement below each indicator on a solenoid armature so that, in one form of the invention, actuation of the armature causes one end of the U-shaped yoke to engage the respective indicator and move it either from its first position to its second position or from its second position to its first position, depending upon the initial position of the indicator. In another form of the invention, a lockout switch is associated with each indicator and is actuated by that indicator when in said lockout position to prevent further energization of the solenoid until a subsequent event, i.e., when all of the indicators are in their lockout position. A lockout override switch circuit is provided to negate the affects of the lockout switches and to permit continuous "flip-flop" movement of the indicators.

Other objects, features and advantages of the invention will be apparent from the following detailed description taken in connection with the accompanying drawings.

BRIEF DESCRIPTION OF THE DRAWINGS

FIG. 3 is a top plan view, on an enlarged scale, of the target device of the present invention;

FIG. 4 is a vertical section of one of the elements of the target device, taken generally along line 4—4 of FIG. 4;

FIG. 5 is a vertical section, similar to FIG. 4, showing the indicator thereof being moved between its horizontal positions;

FIG. 6 is a front elevational view of one of the elements of the target device, taken generally along line 6—6 of FIG. 4; and FIG. 7 is a horizontal section of one of the elements of the target device, taken generally along line 7—7 of FIG. 4.

DESCRIPTION OF THE PREFERRED EMBODIMENT

Figure 2:
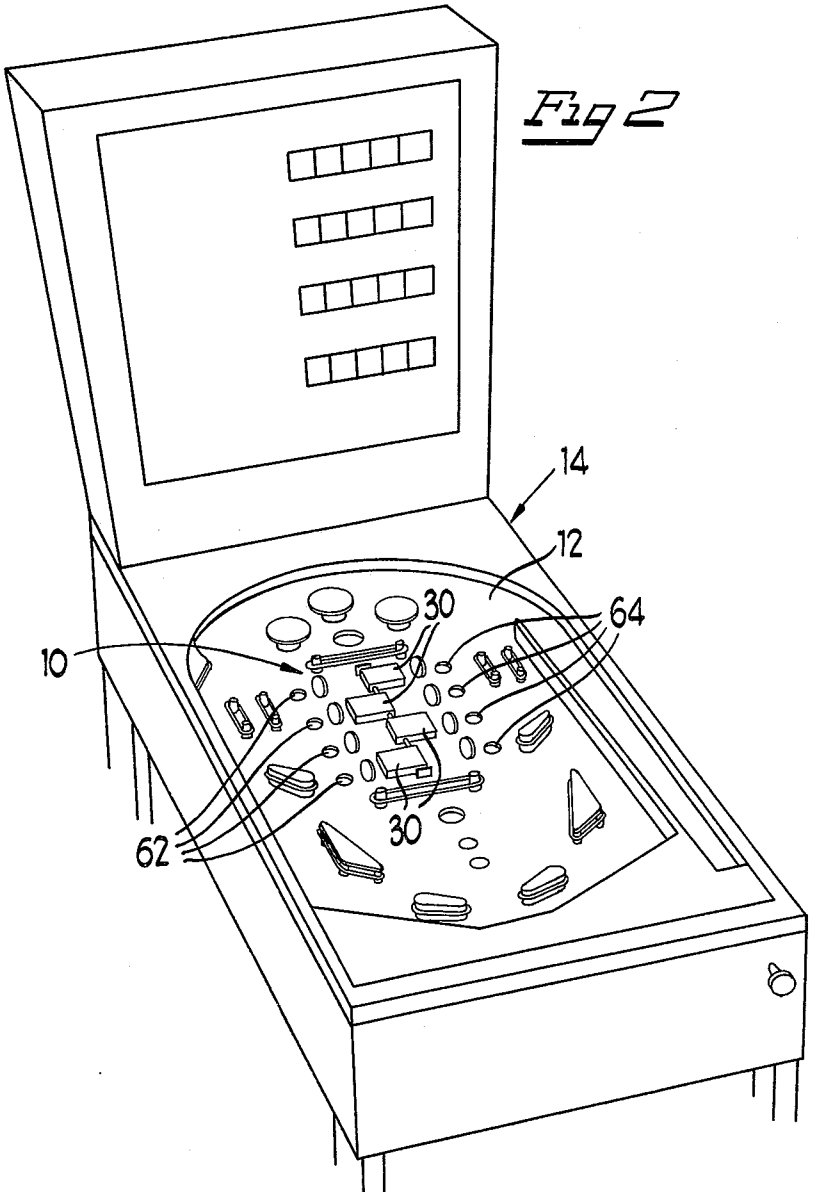
FIG. 2 is a perspective view, similar to FIG. 1, showing the target device of the present invention mounted in a generally longitudinal position generally centrally of the playing surface of the pinball game.
Figure 1:
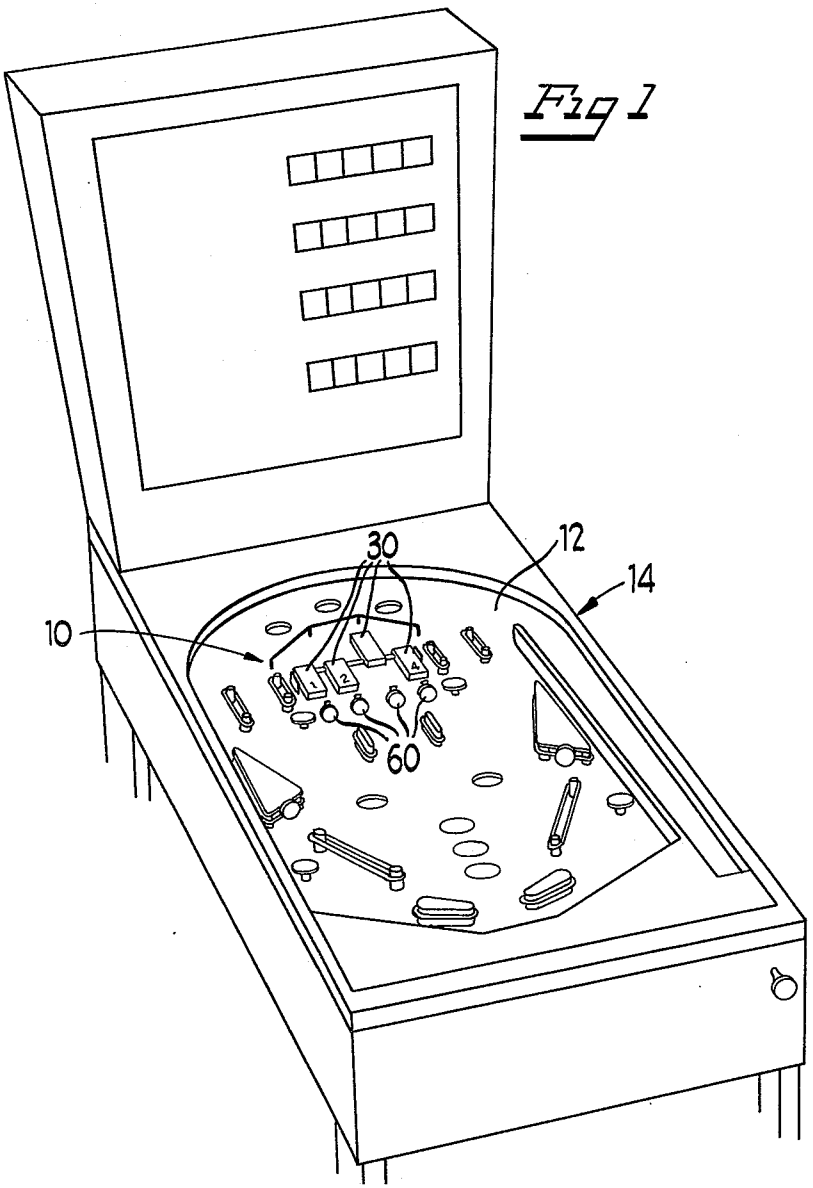
FIG. 1 is a perspective view of the target device of the present invention mounted in a generally transverse position on the upper portion of the playing surface of a pinball game apparatus.

The target device of the present invention, generally designated 10 (FIGS. 1–3), is shown mounted to the playing surface 12 of a pinball machine, generally designated 14 in FIGS. 1 and 2. FIG. 1 shows the target device 10 mounted in a generally transverse position on the playing surface 12 in the upper area thereof, and FIG. 2 shows the target device 10 mounted in a generally longitudinal position generally centrally on the playing surface 12. The operation of the target device 10 and its relationship to the pinball machine 14 in FIGS. 1 and 2 will be described hereinafter, following a detailed description of the target device 10 with references to FIGS. 3 through 7.

Referring to FIG. 3, the target device 10 includes a frame, generally designated 20, having a base plate 22 which is mounted flush with the playing surface 12 of the pinball machine. A pair of upstanding, generally L-shaped brackets 24 are mounted on opposite sides of the base plate 22 and support a generally horizontal axle 26 which is inserted through appropriate apertures provided in the upstanding legs of the L-shaped brackets 24. A retaining C-washer 28 is provided on the outer ends of the axle 26 after assembly. A plurality of generally rectangular indicator blocks or flipper paddles 30 are pivotally mounted on the axle 26 by a complementary aperture or journal through one end of each flipper paddle 30. Each flipper paddle 30 includes a two-sided friction pad 32 for use to prevent wear, as will be described in detail hereinafter. In the preferred embodiment, four flipper paddles are mounted on the axle 26 to show the cooperative working relationship of the paddles and, while this number is only exemplary and can be increased or decreased, it should be understood to be representative of the principles involved in the present invention.

A generally tubular spacer 34 (FIG. 3) is mounted coaxially on the shaft between adjacent flipper paddles 30 to maintain the paddles in a spaced relationship.

A mounting bracket 40 (FIGS. 3, 4 and 5) is mounted below the base plate 22 by a plurality of screws 42 and spacers 44. A depending solenoid support flange 46 is mounted below the bracket 40 to support a solenoid 48 generally below the horizontal axle 26 for each flipper paddle 30. A U-shaped bracket or yoke 50 is mounted to the top of each of the respective armatures 52 for the solenoids and extends through apertures 54 (FIG. 4) in the mounting bracket and apertures 56 in the base plate 22. One of the ends of the U-shaped bracket 50 will contact one side of the friction pad 32 of the respective flipper paddle 30 when the respective solenoid is energized and its armature 52 is moved upwardly in the direction of arrow A (FIG. 5). The upward movement of the armature is represented by the change in position between FIGS. 4 and 5. The impact of the U-shaped bracket 50 on the friction pad 32 of the flipper causes the flipper to pivot in the direction of arrow B about the axle 26, as shown in FIG. 5.

For simplicity, the flipper paddles 30 are shown in their first or beginning position in FIG. 3 and moved to their second or lockout position when pivoted to the opposite side of the axle 26. Note that in FIG. 1, the flipper paddles, designated "1", "2", and "4" are in their first or beginning positions while flipper paddle "3" is in its second position.

In one embodiment (FIG. 5), after a flipper paddle 30 has been moved to its second position, a subsequent actuation of the solenoid 48 will cause the U-shaped bracket to impinge the opposite surface of the friction pad 32 and thus cause the flipper paddle 30 to move back to its beginning or first position in a direction opposite that of arrow B. Thus, the flipper paddles 30 can be made to move from the first position to the second position and back again by continuous intermittent actuation of the solenoid 48.

In the embodiment shown in FIG. 1, a plurality of upstanding bumper discs 60 are shown, one in front of each of the four flipper paddles 30. Contact between a pinball and one of the bumper discs will close a limit switch (not shown, but in circuit with the solenoid 48) which thereby energizes the solenoid of the respective flipper paddle causing it to move the flipper paddle from either its beginning position to its second position or vice versa.

In the embodiment of FIG. 2, the target device 10 is mounted with the axle 26 longitudinally aligned with the playing surface. In this embodiment, holes 62 on the lefthand side and holes 64 on the righthand side of the target device are associated with switches mounted below the playing surface (not shown) connected to the solenoids for each of the flipper paddles 30 to move the flipper paddles between a righthand position and a lefthand position. For example, a ball dropping into one of the holes 62 will close the switch and actuate the respective solenoid to move the respective flipper paddle from its lefthand position, generally on the left side of the horizontal axis, to a righthand position, generally on the righthand side of the horizontal axis. And likewise a pinball dropping in one of the holes 64 will close the switch and actuate the respective solenoid to move the respective flipper paddle from the righthand side back to the lefthand side. However, as described above, each actuation of the solenoid 48 will cause the U-shaped bracket to impinge the friction pad 32 of the flipper 30 and move the flipper to its complementary position.

In the embodiment shown in FIG. 1, for example, it may be desirable to prevent the flipper paddles from moving back to their beginning position until all of the flipper paddles have been moved to their second or lockout position. This lockout feature is used to provide a new type of game as in FIG. 2. A lockout switch means generally designated 66 (FIGS. 4, 6 and 7) is provided to prevent continuous energization of the solenoid 48 for the respective flipper paddles every time a ball drops through one of the holes 62 or 64. The embodiment of the lockout switch 66 shown in FIGS. 4, 6 and 7 is adapted and described for use with the target device 10 when used in either the longitudinal position on a pinball game as shown in FIG. 2 as well as with the disposition shown in FIG. 1.

The lockout switch means 66 shown in FIG. 4 includes an upper movable contact 68, a center stationary contact 70, and a lower movable contact 72. The contact set or switch 66 is operated by a wire spring 74 which is pivotally mounted by a pair of depending tabs 76 on the lower surface of the mounting bracket 40 (FIG. 7). One end of the spring 78 emerges upwardly through the base plate 22 for engagement with the respective flipper paddle 30 when in its beginning position. The other end of the spring 80 (FIG. 7) engages the top of the upper movable contact 68. An insulator 82 is secured to the bottom of the top movable contact 68 and engages the lower movable contact 72 so that when a flipper paddle 30 is in its beginning position, as shown in FIG. 4, the upper movable contact 68 engages the stationary contact 70 while the lower movable contact 72 is out of engagement. When a flipper paddle 30 is in its second or lockout position (not shown) the spring 74 will pivot upwardly and the lower movable contact 72 will engage the stationary contact 70 while the upper contact 68 moves out of engagement with the stationary contact 70.

As applied to the arrangement of FIG. 2, if the upper contact sets 68 and 70 for all of the flipper paddles are connected in series with the switches below the apertures 64 and the lower contact sets 70 and 72 are connected in series with the switches below the apertures 62, the desired results will be achieved. For example, with reference to FIG. 2, the upper or rearwardmost flipper paddle represents the position of the flipper paddle as shown in FIG. 4. The upper contact set 68 and 70 for the flipper paddle is closed in this beginning position. When a pinball falls through the aperture 64 for that flipper paddle, it will close the switch below the hole and the respective solenoid 48 will be energized through the upper contact set 68 and 70 to move the flipper paddle 30 to its opposite position. However, a pinball falling through the uppermost aperture 62 will not actuate the solenoid because the switch set within the aperture 62 cannot actuate the solenoid since the lower contact sets 70 and 72 are broken.

After the flipper has been flipped to its second or lockout position, the upper contact set 68 and 70 is open while the lower contact set 70 and 72 is closed. In this position, a ball entering one of the apertures 62 will close the switch below the aperture which is in series with the solenoid through the contact set 70 and 72 and thus energizes the solenoid to move the flipper paddle back to its beginning position. Likewise, again a pinball falling through the incorrect aperture 64 cannot energize the solenoid 48 because the contact set 68 and 70, connected in series therewith, is broken. Thus, the flipper paddles 30 will only move to their opposite position when the pinball drops through the correct aperture 62 or 64.

As noted above, this same lockout switch 66 can be incorporated in the design represented in FIG. 1, but only one set of contacts is needed. In this embodiment, it is desirable that a contact set, such as the upper set 68 and 70, be closed when the flipper paddles are in their initial position and be open when the flipper paddles are in their second or lockout position. For example, the flipper paddles "1", "2" and "4" in FIG. 1 are represented by FIG. 4 showing the uppermost contact set 68 and 70 closed while the flipper 30 which is in its lockout position has a contact set 68, 70 which is broken or open. In this manner, each flipper paddle is moved to its second or lockout position while none of the flipper paddles can be moved back to their beginning positions since their contacts 68 and 70 are broken. An override circuit or switch (not shown) can be provided to actuate all the solenoids and flip all of the flipper paddles 30 back to their initial position after the user has successfully moved all of the paddles to their second or lockout position. The override circuit merely connects all of the solenoids to the power source independently of the lockout switch 66.

The same result could be achieved automatically by using the switch 66 as described but connecting the lower contact set 70 and 72 all in series with one another, the power source, and all of the solenoids so that as the final or last flipper paddle is moved to its second or lockout position, all of the contact sets 70 and 72 are closed which then will energize all of the solenoids 48 to immediately move the flipper paddles 30 back to their original position.

Alternatively, the lower set of contacts 70 and 72 can be connected with a scoring device to total up the score as each flipper paddle is moved to its second position.

Many different adaptations and changes, particularly in the circuitry connecting the lockout switch 66 with various other elements are possible without departing from the present invention.

The foregoing detailed description has been given for clearness of understanding only and no unnecessary limitations should be understood therefrom as some modifications will be obvious to those skilled in the art.

I claim:

1. A target device for a pinball game, comprising:

a frame having means defining a playing surface over which pinballs are rollingly supportable;

an indicator member pivotally mounted on the frame for pivotal movement over the playing surface about an axis generally parallel and adjacent to the playing surface between first and second limit positions; and actuating means operatively associated with said movable indicator and actuatable in response to engagement thereof by a pinball rolling on said playing surface for moving the indicator from either of said limit positions to the opposite limit position.

2. The device of claim 1 wherein said actuating means includes switch means engageable by said pinball for actuation thereof in response to closure thereof by engagement with said pinball rolling on said playing surface.

3. The device of claim 1 wherein said indicator member is pivotally mounted about a generally horizontal axis generally parallel to said playing surface for movement upwardly thereabout over the playing surface approximately 180° between said limit positions.

4. The device of claim 3 including a plurality of said indicators pivotally mounted on a common horizontal axis.

5. A target device for a pinball game, comprising:

a frame having means defining a playing surface over which pinballs are rollingly supportable;

at least one indicator member pivotally mounted on the frame for pivoting movement of approximately 180° over the playing surface about an axis adjacent to the playing surface between first and second limit positions;

actuating means including a solenoid having a vertically reciprocating armature and an upstanding U-shaped yoke mounted for generally vertical reciprocal movement on the armature of the solenoid, one leg of the yoke being engageable with the indicator member when in said beginning position and the other leg of the yoke being engageable with the indicator member when in said lockout position to move the indicator member between the beginning position and lockout positions upon energization of said solenoid;

switch means, including engaging means, connected to said solenoid for energization thereof in response to closure of said switch means by engagement of the engaging means by a pinball rolling on said playing surface; and selectively operable lockout means operatively associated with said solenoid to prevent energization thereof when said indicator member is in said lockout position.

6. The device of claim 5 wherein said lockout means includes a pair of alternately engageable contacts associated with a first and second switch means whereby said solenoid can be energized when said indicator member is in its beginning position only by closure of said first switch means, and whereby said solenoid can be energized when the indicator member is in said lockout position only by closure of said second switch means.

7. The device of claim 6 including a lockout override means to override said lockout means to thereby permit continuous pivotal movement of said indicator in response to continuous, intermittent energization of said solenoid.

8. A target device for a pinball game, comprising:

a frame having means defining a playing surface over which pinballs are rollingly supportable;

an indicator member pivotally mounted on the frame for pivoting movement over the playing surface about an axis adjacent the playing surface between a first and second limit position; and actuating means operatively associated with said movable indicator and actuatable in response to engagement thereof by a pinball rolling on said playing surface for moving the indicator between the respective limit positions, said actuating means including a yoke having a pair of upstanding legs, one leg of the yoke being engageable with the indicator member when in said first position and the other leg of the yoke being engageable with the indicator member when in said second position, said yoke being mounted for reciprocal movement with respect to said indicator member to contact the indicator member when in the first or second position.

9. The device of claim 8 wherein said actuating means includes a solenoid connected to said U-shaped yoke for moving the yoke into engagement with said indicator member upon energization of said solenoid.

10. The device of claim 9 including switch means connected with said solenoid for energization thereof in response to closure of said switch means by a pinball.

11. A target device for a pinball game, comprising:

a frame having means defining a playing surface over which pinballs are rollingly supportable;

an indicator member pivotally mounted on the frame for pivoting movement over the playing surface about an axis adjacent the playing surface between a first and a second limit position;

actuating means operatively associated with said movable indicator and actuatable in response to engagement thereof by a pinball rolling on said playing surface for moving the indicator between the respective limit positions; and lockout means associated with said actuating means to prevent actuation thereof when the indicator member is in one of said limit positions.

12. The device of claim 11 wherein said lockout means includes a lockout switch operatively associated with said indicator member, said lockout switch being operable in said one position of said indicator member whereby operation of said lockout switch prevents subsequent actuation of the actuating means.

13. The device of claim 12 including a lockout override means to override said lockout means to thereby permit the return of said indicator member from said one position by actuation of said actuating means.

14. A target device for a pinball game, comprising:

a frame having means defining a playing surface over which pinballs are rollingly supportable;

an indicator member pivotally mounted on the frame for pivoting movement over the playing surface about an axis adjacent the playing surface between a first and a second limit position; and actuating means operatively associated with said movable indicator and actuatable in response to engagement thereof by a pinball rolling on said playing surface for moving the indicator between the respective limit positions, said actuating means including a first and a second switch means engageable by a pinball for actuation thereof in response to closure of either said first or said second switch means by engagement with a pinball rolling on said playing surface.

15. The device of claim 14 including lockout means associated with said indicator member and said first and second switch means, to prevent actuation of the actuating means upon closure of said second switch means by a pinball while permitting actuation of the actuating means by closure of said first switch means by a pinball when the indicator member is in said first position, and to prevent actuation of said actuating means upon closure of said first switch means by a pinball while permitting actuation of said actuating means by closure of said second switch means by a pinball when the indicator member is in said second position.

16. The device of claim 15 wherein said lockout means includes a lockout switch operatively associated with said indicator member, said lockout switch comprising a pair of contact sets, said pair of contact sets being movable so that the opening of a first set by movement of the indicator member effects a closing of the second set, said pair of contact sets being connected to said first and second switch means, respectively, so as to permit operation of the actuating means only upon closure of the respective first or second switch means by a pinball.

* * * * *